US012734396B2

(12) United States Patent
Byun

(10) Patent No.: US 12,734,396 B2
(45) Date of Patent: Sep. 15, 2026

(54) LEG EXTENSION MACHINE

(71) Applicant: NEWTECH WELLNESS CORPORATION, Gimhae-si (KR)

(72) Inventor: Hyun Jung Byun, Busan (KR)

(73) Assignee: NEWTECH WELLNESS CORPORATION, Gimhae-si (KR)

( * ) Notice: Subject to any disclaimer, the term of this patent is extended or adjusted under 35 U.S.C. 154(b) by 30 days.

(21) Appl. No.: 18/809,264

(22) Filed: Aug. 19, 2024

(65) Prior Publication Data

US 2025/0276209 A1 Sep. 4, 2025

(30) Foreign Application Priority Data

Mar. 4, 2024 (KR) ..... 10-2024-0030601

(51) Int. Cl.
*A63B 21/00* (2006.01)
*A63B 21/062* (2006.01)
*A63B 22/00* (2006.01)

(52) U.S. Cl.
CPC ..... *A63B 21/4039* (2015.10); *A63B 21/063* (2015.10); *A63B 2022/0033* (2013.01)

(58) Field of Classification Search
CPC ..... A63B 21/00069; A63B 21/00072; A63B 21/0628; A63B 21/063; A63B 21/0632; A63B 21/152; A63B 21/155; A63B 21/4039; A63B 21/4047; A63B 21/4049; A63B 22/0046; A63B 2022/0033; A63B 23/03516; A63B 23/04; A63B 23/0494; A63B 2208/0233; A63B 2225/09; A63B 2225/093; A63B 2244/09
See application file for complete search history.

(56) References Cited

U.S. PATENT DOCUMENTS 4,982,956 A * 1/1991 Lapcevic ..... A63B 21/0617 482/100
5,088,726 A * 2/1992 Lapcevie ..... A63B 21/155 482/97
5,213,556 A * 5/1993 Boren ..... A63B 21/0628 482/137

(Continued)

FOREIGN PATENT DOCUMENTS

CN 117046046 A * 11/2023 ..... A63B 23/04
KR 20-0453493 Y1 5/2011

(Continued)

*Primary Examiner* — Gary D Urbiel Goldner
(74) *Attorney, Agent, or Firm* — Revolution IP, PLLC

(57) ABSTRACT

A leg extension machine includes a frame portion supported by a bottom surface thereof and standing upright; a seating portion that is connected to the frame portion and provides a space for a user to sit, and a standing angle and a height which are adjustable; an exercise rotation portion connected to the frame portion, disposed adjacent to the seating portion to provide a space for the user to be seated and hang his or her legs, and rotated by an external force applied by the user; a weight portion supported by the frame portion and accommodating a plurality of weights; and a weight delivering portion connected to the frame portion, connecting the exercise rotation portion and the weight portion, and linked to the rotation of the exercise rotation portion to raise and lower the plurality of weights of the weight portion.

5 Claims, 9 Drawing Sheets

(56) References Cited

U.S. PATENT DOCUMENTS

| | | | | | |
|---|---|---|---|---|---|
| 5,338,274 | A * | 8/1994 | Jones | A63B 21/0615 | 482/142 |
| 5,356,360 | A * | 10/1994 | Johns | A63B 21/0628 | 482/99 |
| 5,499,962 | A * | 3/1996 | Jones | A63B 21/0628 | 482/142 |
| 5,667,465 | A * | 9/1997 | McCollum | A63B 21/0628 | 482/137 |
| 6,558,303 | B1 * | 5/2003 | Ellis | A63B 23/0494 | 482/142 |
| 6,676,574 | B1 * | 1/2004 | Prokop | A63B 23/0494 | 482/137 |
| 6,719,672 | B1 * | 4/2004 | Ellis | A63B 21/063 | 482/99 |
| 10,004,972 | B2 * | 6/2018 | Young | A63B 21/4034 | |
| 12,515,091 | B1 * | 1/2026 | Nolan | A63B 21/155 | |
| 2003/0092541 | A1 * | 5/2003 | Giannelli | A63B 21/4047 | 482/99 |
| 2019/0111299 | A1 * | 4/2019 | Radcliffe | A61H 1/0274 | |

FOREIGN PATENT DOCUMENTS

| | | | | |
|---|---|---|---|---|
| KR | 102713307 | B1 * | 10/2024 | A63B 21/063 |
| WO | WO-2005089881 | A1 * | 9/2005 | A63B 23/03525 |

* cited by examiner

LEG EXTENSION MACHINE

BACKGROUND OF THE INVENTION

The present disclosure relates to a leg extension machine, and, more particularly, to a leg extension machine allowing a seated user to work out by raising a lever connected to a weight to lift the weight and adjust the machine to suit not only the length but also the thickness of the user's legs.

Recently, as interest in prevention of obesity or adult diseases and self-management has increased, a lot of people of all ages and genders have enjoyed a variety of types of exercise. There may be various types of exercise for that purpose, but, in recent days, many people sign up for gyms to exercise.

A number of people use gyms because they are equipped with a variety of exercise equipment and allow users to appropriately adjust weight loads for muscular work outs to suit their individual physical condition and amount of exercise. In addition, at gyms, it is possible to exercise without restrictions due to season, weather, and time.

In general, exercises available at gyms can be largely divided into aerobic exercise and machine exercise, and can be further divided into upper body muscle exercise, lower body muscle exercise, abdominal muscle exercise, etc., depending on the purpose of exercise.

Among them, examples of representative exercise equipment for lower body muscle exercise include leg curl machines, leg extension machines, aerial walking machines, etc.

In the case of a conventional leg extension machine, it is possible to adjust the position of a seat to suit the length of a user's legs, but it is impossible to adjust the machine to fit the thickness of the user's thighs, causing inconvenience in use.

Therefore, research on a leg extension machine that can be adjusted to not only the length but also the thickness of a user's legs is required.

RELATED ART LITERATURE

Patent Literature (Patent Literature 1) Korea Utility Model No. 20-0453493

SUMMARY OF THE INVENTION

The present disclosure has been made in an effort to provide a leg extension machine allowing a seated user to work out by raising a lever connected to a weight to lift the weight and adjust the machine to suit not only the length but also the thickness of the user's legs.

In addition, the present disclosure has been made in an effort to provide a leg extension machine designed to be compact not only to reduce production costs but also to provide convenience in maintenance and management.

A leg extension machine according to an embodiment of the present disclosure may include a frame portion supported by the bottom surface and standing upright; a seating portion that is connected to the frame portion and provides a space for a user to sit and the standing angle and the height of which are adjustable; an exercise rotation portion connected to the frame portion, disposed adjacent to the seating portion to provide a space for a seated user to hang his or her legs, and rotated by an external force applied by the user; a weight portion supported by the frame portion and accommodating a plurality of weights; and a weight delivering portion connected to the frame portion, connecting the exercise rotation portion and the weight portion, and linked to the rotation of the exercise rotation portion to raise and lower the weight of the weight portion. The seating portion may include a hip seating portion supporting the buttocks of a seated user; a back seating portion supporting the back of a seated user; a seating angle adjuster connected to the frame portion and the back seating portion to be used to adjust the angle of the back seating portion; and a plurality of grip portions connected to both sides of the hip seating portion and arranged in parallel with the hip seating portion for a user to grip them.

The frame portion according to an embodiment of the present disclosure may include a lower support portion supported by the bottom surface; a weight accommodating portion disposed at the rear of the seating portion, standing up from the lower support portion, and having an internal space to accommodate the weight portion; a seating support portion standing up from the lower support portion and supporting the seating portion; a delivering support portion standing up from the lower support portion and disposed adjacent to the weight accommodating portion to support the weight delivering portion; and an exercise support portion connecting the delivering support portion and the seating support portion and supporting the exercise rotation portion. The seating support portion may include a pair of seating support pieces supporting the hip seating portion; a pair of bending support pieces extending from the first point of the pair of seating support pieces; a rotating support piece connecting the pair of seating support pieces and the back seating portion, where a plurality of rotational links are provided in the space between the pair of seating support pieces so that the back seating portion rotates; and a seating height adjuster arranged to adjust the height of the pair of bending support pieces and having one end link-connected to one point of the lower support portion and the other end link-connected to the pair of bending support pieces.

The seating angle adjuster according to an embodiment of the present disclosure may include an angle adjusting plate fixed to the rotational link, operating in conjunction with the back seating portion, and formed in a fan shape; a plurality of angle adjusting holes penetrating the angle adjusting plate and spaced apart from each other along an arc shape; a fixing lever module coupled to the second point of the seating support piece and inserted into at least one of the plurality of angle adjusting holes to fix the angle of the back seating portion; and a damper connecting the third point of the seating support piece and the first point of the angle adjusting plate and pulling the angle adjusting plate toward the third point of the seating support piece when the fixing lever module is released.

The weight portion according to an embodiment of the present disclosure may include a weight stacking portion accommodated in the weight accommodating portion and formed by stacking a plurality of weights separable from each other; a wire having one side connected to the weight delivering portion and the other side connected to the weight stacking portion and raising and lowering the weight stacking portion based on the movement of the weight delivering portion; a weight mediating portion connecting the wire and the weight stacking portion and allowing a selected subordinate weight to vary according to how the weight stacking portion is connected; an intermediate pin determining how the weight mediating portion and the weight stacking portion are connected to each other; and a guide roller providing a movement path for the wire while being accommodated in the weight accommodating portion. The guide roller may include a first upper roller piece disposed on the upper side within the weight accommodating portion and disposed on the same line as the weight mediating portion; a second upper roller piece accommodated in the weight accommodating portion, disposed adjacent to the first upper roller piece, and disposed biased toward the weight delivering portion; and a lower roller piece accommodated in the weight accommodating portion, disposed below the second upper roller piece, and disposed adjacent to the weight delivering portion. The weight delivering portion may include a delivering rotation axis connected rotatably to the delivering support portion; and a delivering control plate connected to and interlocked with the delivering rotation axis and rotated by the wire. The delivering control plate may include a first fan-shaped portion formed in a fan shape; a plurality of first through holes penetrating the first fan-shaped portion and spaced apart from each other along an arc shape; a wire fixing portion formed on one side of the first fan-shaped portion to fix the wire; and a wire guide portion guiding the wire fixed to the wire fixing portion to be disposed along the outer peripheral surface of the first fan-shaped portion.

The exercise rotation portion according to an embodiment of the present disclosure may include a connection rotation axis formed in concentric multi-stages to surround the outer peripheral surface of the delivering rotation axis and connected thereto to rotate around the delivering rotation axis; an interlocking bar connected perpendicularly to the connection rotation axis; an adjustment rotation axis connected rotatably to the end of the interlocking bar; an exercise control plate formed at the end of the interlocking bar; and an exercise connection portion connected to the adjustment rotation axis, providing a space where a resting portion, on which a user's legs can rest, is mounted, and connected detachably to the exercise control plate. The connection rotation axis may include a bending selection portion disposed parallel to the first fan-shaped portion and having both ends disposed on top of the plurality of first through holes; and an interlocking button portion formed at the end of the bending selection portion, inserted into one of the plurality of first through holes and then released from the through hole by an applied external force, and returned to be inserted into an opposing through hole when the applied external force is released. Depending on the position where the interlocking button portion is connected to the first fan-shaped portion, the angle between the bottom surface and the interlocking bar may change, changing the resting portion's height from the bottom surface. The exercise control plate may include a second fan-shaped portion formed in a fan shape; and a plurality of second through holes penetrating the second fan-shaped portion and spaced apart from each other along an arc shape. The exercise connection portion may include an exercise selection portion disposed parallel to the second fan-shaped portion and having both ends disposed on top of the plurality of second through holes; and an exercise button portion formed at the end of the exercise selection portion, inserted into any one of the plurality of second through holes and then released from the through hole by an applied external force, and returned to be inserted into an opposing through hole when the applied external force is released. Depending on the position at which the exercise button portion is connected to the second fan-shaped portion, the distance between the resting portion and the seating portion may be changed.

The leg extension machine according to one embodiment of the present disclosure may allow a seated user to work out by raising a lever connected to a weight to lift the weight and adjust the machine to suit not only the length but also the thickness of the user's legs.

In addition, the leg extension machine according to one embodiment of the present disclosure may be designed to be compact not only to reduce production costs but also to provide convenience in maintenance and management.

DETAILED DESCRIPTION

Hereinafter, the specific embodiments of the present disclosure will be described in detail with reference to the drawings. However, the technology of the present disclosure is not limited to the presented embodiments. A person having ordinary in the art who understands the technology of the present disclosure would be able to easily suggest other embodiments within the technology of other regressive disclosures or the present disclosure by adding, changing, or removing components within the technology of the present disclosure, but such embodiments can also be said to be within the technology of the present disclosure.

Hereinafter, a leg extension machine 1 according to the present disclosure will be described in detail with reference to the attached FIGS. 1 to 8.

Figure 1:
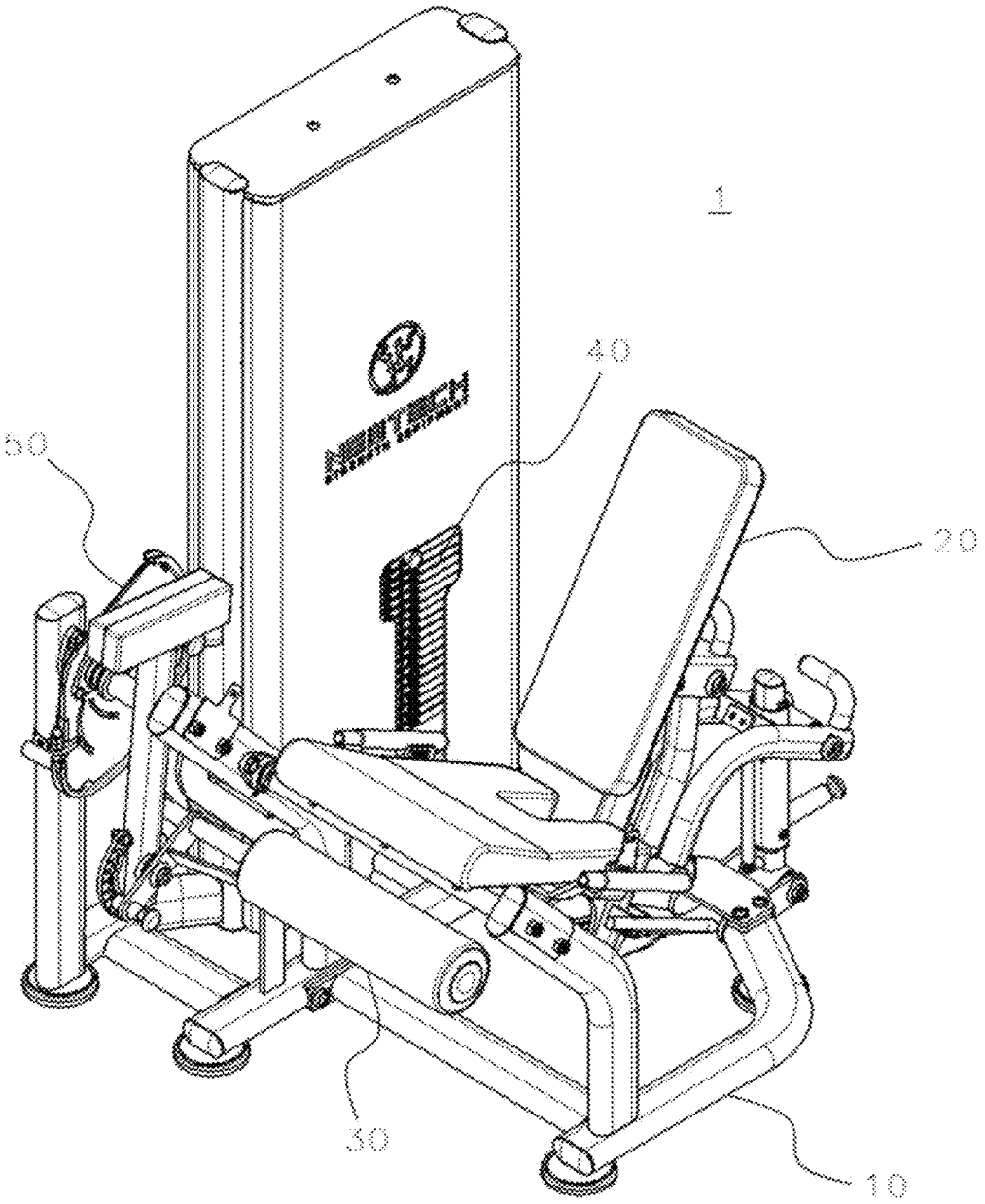
FIG. 1 is a view for illustrating a leg extension machine according to an embodiment of the present disclosure.

FIG. 1 is a view for illustrating the leg extension machine according to an embodiment of the present disclosure.

Referring to FIG. 1, the leg extension machine 1 according to an embodiment of the present disclosure may include a frame portion 10, a seating portion 20, an exercise rotation portion 30, a weight portion 40, and a weight delivering portion 50.

The frame portion 10 may be supported by the floor and stand upright. The frame portion 10 will be examined in more detail with reference to FIG. 2.

Figure 2:
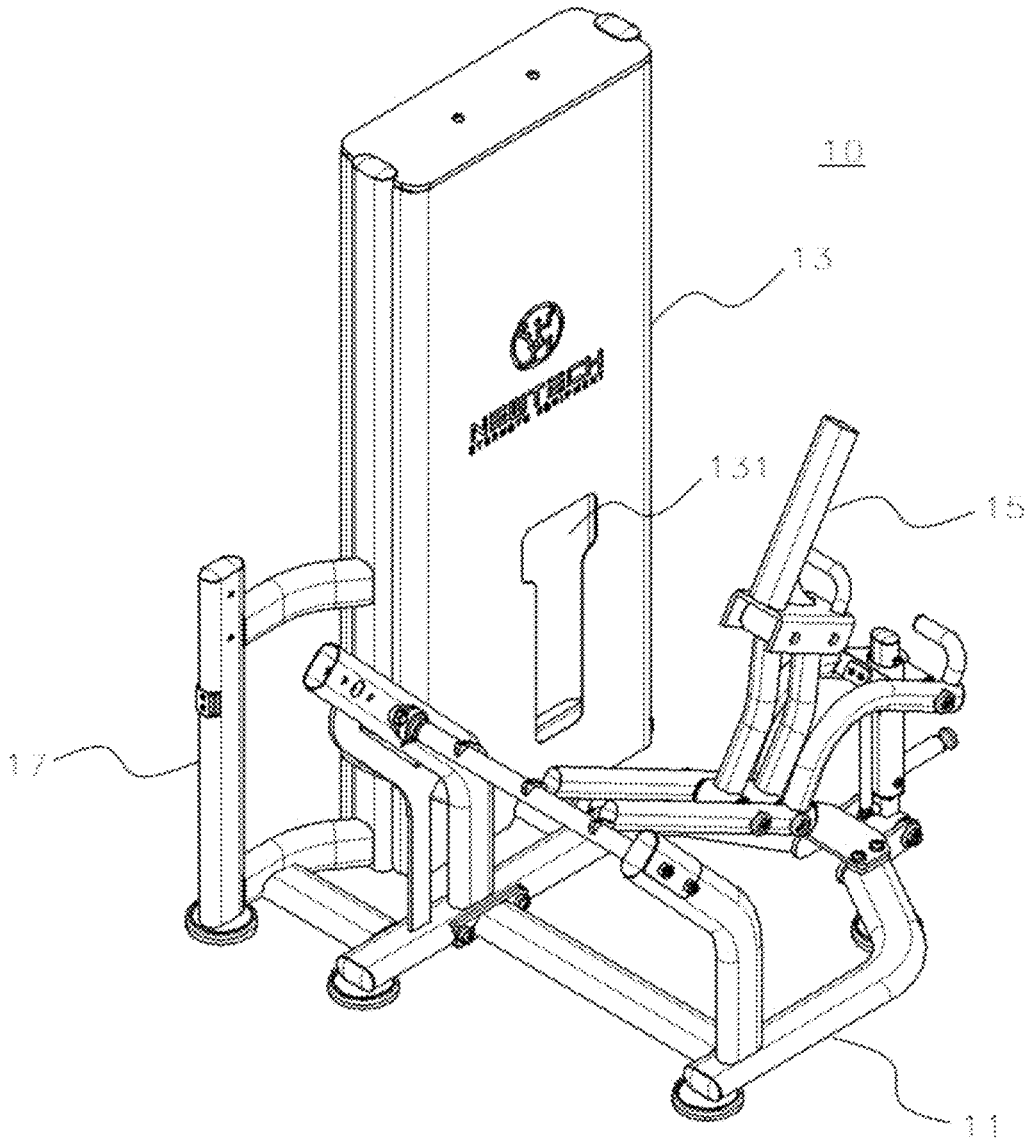
FIG. 2 is a view for illustrating a frame portion according to an embodiment of the present disclosure.

FIG. 2 is a view for illustrating the frame portion according to an embodiment of the present disclosure.

Referring to FIG. 2, the frame portion 10 according to an embodiment of the present disclosure may include a lower support portion 11, a weight accommodating portion 13, a seating support portion 15, and a delivering support portion 17.

The lower support portion 11 may be supported by the floor.

The weight accommodating portion 13 may be disposed at the rear of the seating portion 20, stand up from the lower support portion 11, and have an internal space to accommodate the weight portion 40. The weight accommodating portion 13 may include an adjustment opening 131 that is open on the front side facing the seating portion 20 to expose at least a portion of the weight portion 40 to the outside.

The seating support portion 15 may stand up from the lower support portion 11 and support the seating portion 20. The seating support portion 15 will be examined in more detail with reference to FIG. 3.

Figure 3:
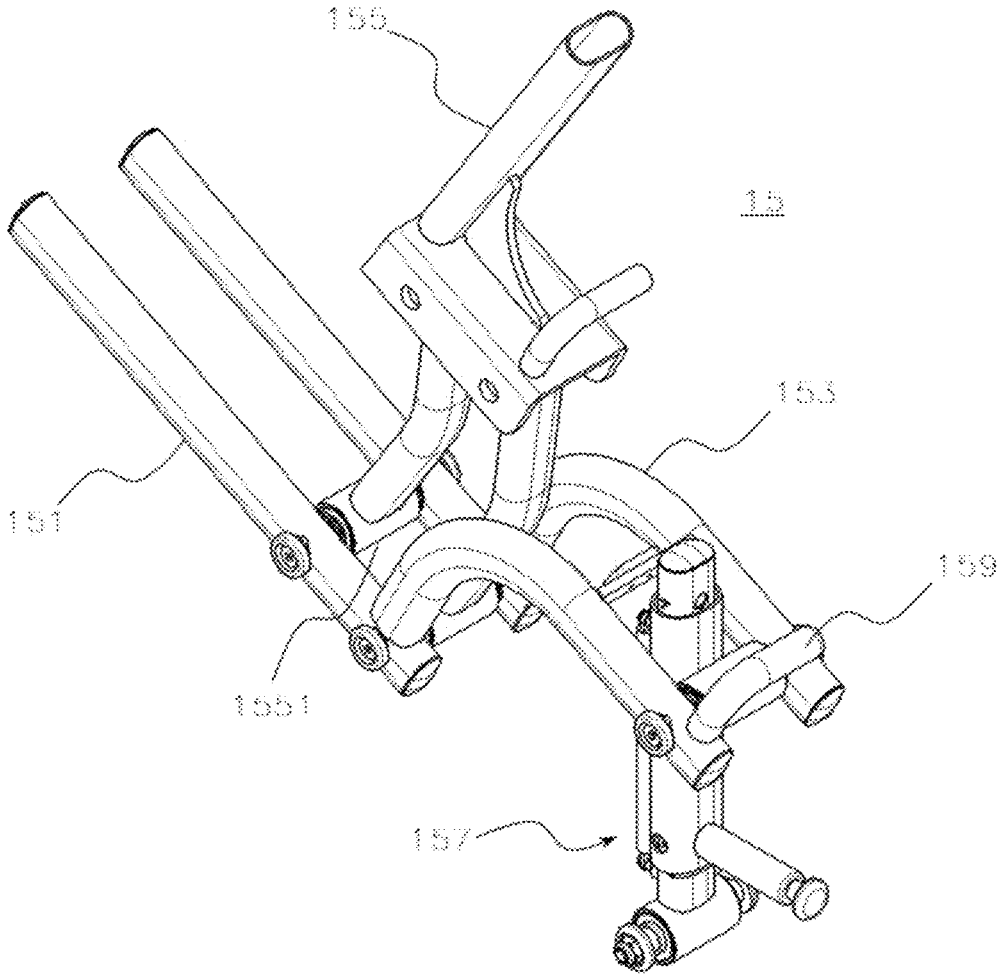
FIG. 3 is a view for illustrating a seating support portion according to an embodiment of the present disclosure.

FIG. 3 is a view for illustrating the seating support portion according to an embodiment of the present disclosure.

Referring to FIG. 3, the seating support portion 15 according to an embodiment of the present disclosure may include a pair of seating support pieces 151, a pair of bending support pieces 153, a rotating support piece 155, and a seating height adjuster 157.

The pair of seating support pieces 151 may support a hip seating portion 21.

The pair of bending support pieces 153 may extend from the first point of the pair of seating support pieces 151.

The rotating support piece 155 may connect the pair of seating support pieces 151 and a back seating portion 23, and a plurality of rotational links 1551 may be provided in the space between the pair of seating support pieces 151 so that the back seating portion 23 can rotate.

One end of the seating height adjuster 157 for adjusting the height of the pair of bending support pieces 153 may be link-connected to one point of the lower support portion 11, and the other end thereof may be link-connected to the pair of bending support pieces 153. The seating height adjuster 157 may include two bars and a height adjustment button. In order to easily adjust the height with the seating height adjuster 157, a height adjustment grip portion 159 may be provided on one point of the bending support piece 153. Because the seating height adjuster 157 may be provided, it may be possible to adjust the angle of the hip seating portion 21 by adjusting the height of one side of the hip seating portion 21.

Referring back to FIG. 2, the delivering support portion 17 may stand up from the lower support portion 11 and may be disposed adjacent to the weight accommodating portion 13 to support the weight delivering portion 50.

Referring back to FIG. 1, the seating portion 20 may be connected to the frame portion 10 and provide a space for a user to sit, and it may be possible to adjust the angle at which the seating portion 20 stands up and the height thereof. The seating portion 20 will be examined in more detail with reference to FIG. 4.

Figure 4:
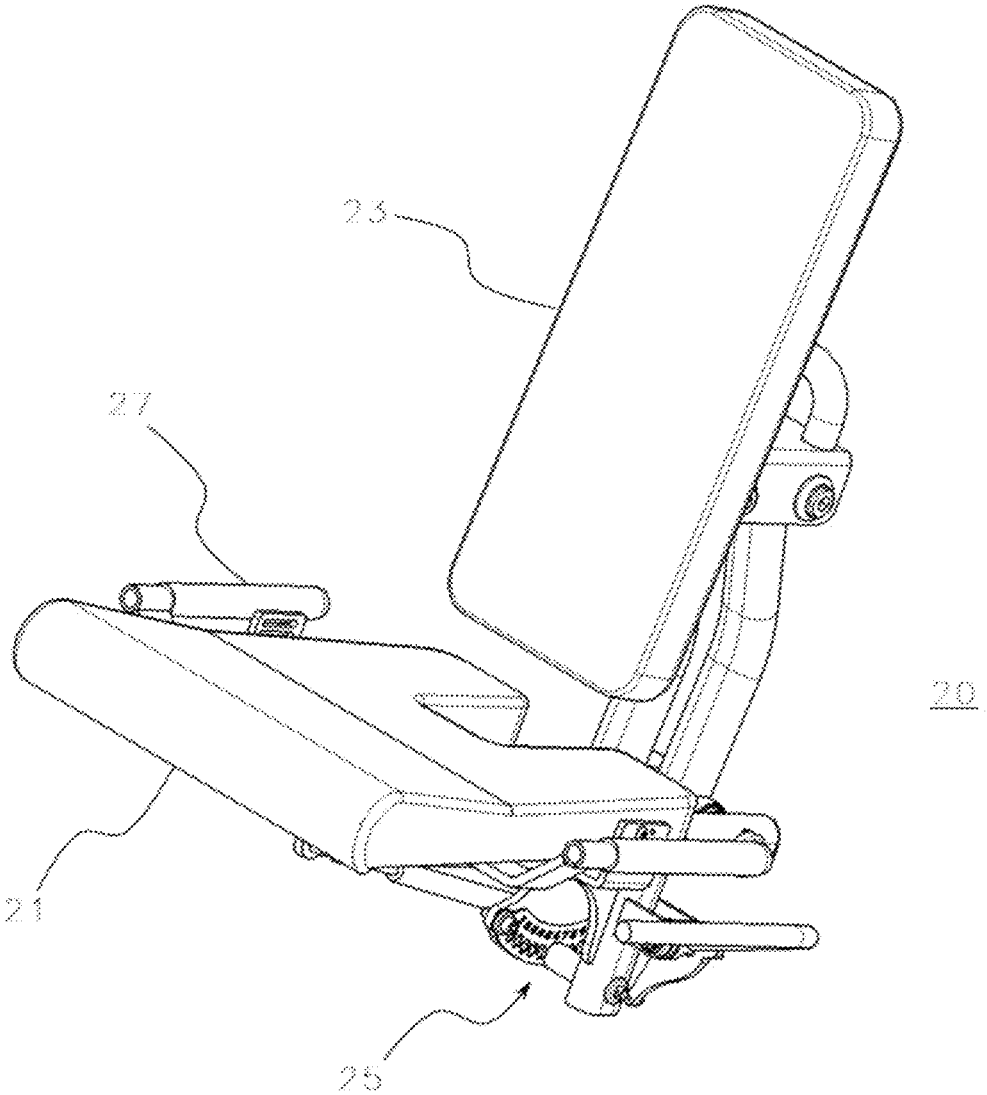
FIG. 4 is a view for illustrating a seating portion according to an embodiment of the present disclosure.

FIG. 4 is a view for illustrating the seating portion according to an embodiment of the present disclosure.

Referring to FIG. 4, the seating portion 20 according to an embodiment of the present disclosure may include the hip seating portion 21, the back seating portion 23, a seating angle adjuster 25, and a pair of grip portions 27.

The hip seating portion 21 may support the buttocks of a seated user.

The back seating portion 23 may support the back of a seated user.

The seating angle adjuster 25 may be connected to the frame portion 10 and the back seating portion 23 and used to adjust the angle of the back seating portion 23. The seating angle adjuster 25 will be examined in more detail with reference to FIG. 5.

Figure 5:
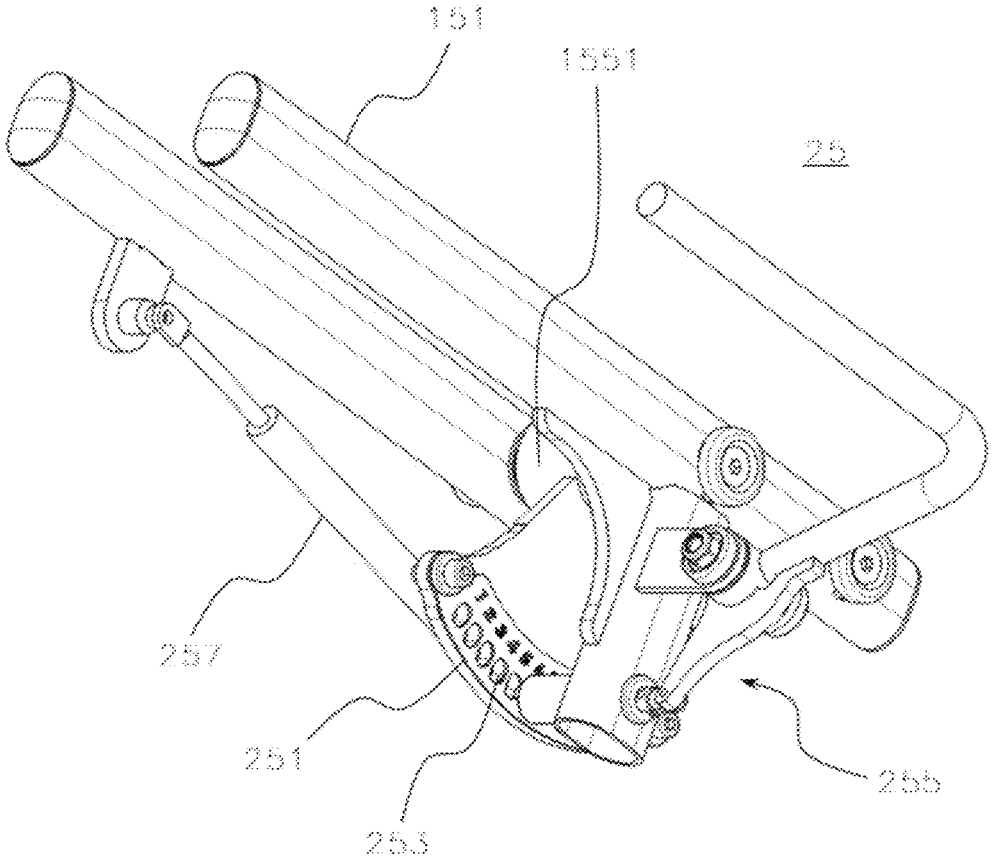
FIG. 5 is a view for illustrating a seating angle adjuster according to an embodiment of the present disclosure.

FIG. 5 is a view for illustrating the seating angle adjuster according to an embodiment of the present disclosure.

Referring to FIG. 5, the seating angle adjuster 25 according to one embodiment of the present disclosure may include an angle adjusting plate 251, a plurality of angle adjusting holes 253, a fixing lever module 255, and a damper 257.

The angle adjusting plate 251 fixed to the rotational link 1551 may operate in conjunction with the back seating portion 23 and may be formed in a fan shape.

The plurality of angle adjusting holes 253 may penetrate the angle adjusting plate 251 and may be spaced apart from each other along an arc shape.

The fixing lever module 255 may be coupled to the second point of the seating support piece 151, and may be inserted into at least one of the plurality of angle adjusting holes 253 to fix the angle of the back seating portion 23.

The damper 257 may connect the third point of the seating support piece 151 and the first point of the angle adjusting plate 251, and may pull the angle adjusting plate 251 toward the third point of the seating support piece 151 when the fixing lever module 255 is released.

Referring back to FIG. 4, the pair of grip portions 27 may be connected to both sides of the hip seating portion 21, and may be arranged parallel to the hip seating portion 21 so that a user can grip them.

Referring back to FIG. 1, the exercise rotation portion 30 may be connected to the frame portion 10 and disposed adjacent to the seating portion 20 to provide a space for a seated user to hang his or her legs, and may be rotated by an external force applied by the user. The exercise rotation portion 30 will be examined in more detail with reference to FIG. 6.

Figure 6:
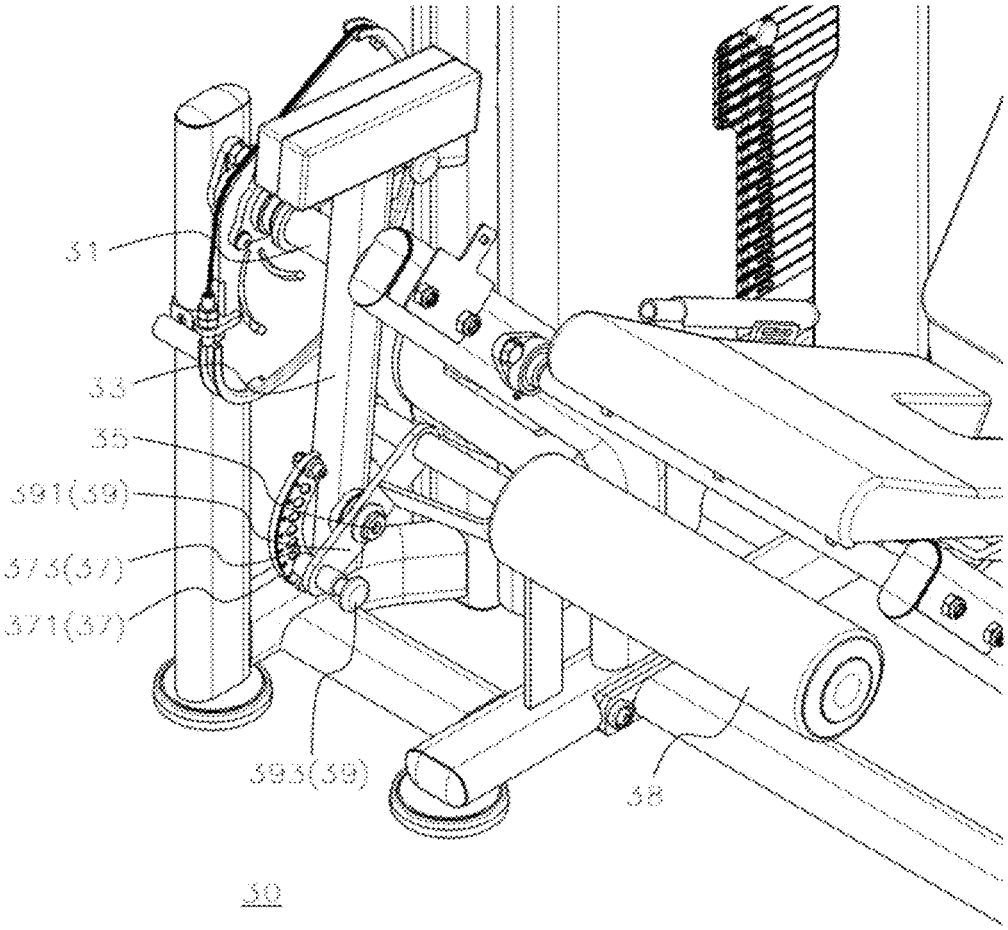
FIG. 6 is a view for illustrating an exercise rotation portion according to an embodiment of the present disclosure.

FIG. 6 is a view for illustrating the exercise rotation portion according to an embodiment of the present disclosure.

Referring to FIG. 6, the exercise rotation portion 30 according to an embodiment of the present disclosure may include a connection rotation axis 31, an interlocking bar 33, an adjustment rotation axis 35, an exercise control plate 37, and an exercise connection portion 39.

The connection rotation axis 31 may be formed in concentric multi-stages to surround the outer peripheral surface of a delivering rotation axis 51 and may be connected thereto to rotate around the delivering rotation axis 51. The connection rotation axis 31 may include a bending selection portion 311 and an interlocking button portion 313.

The bending selection portion 311 may be disposed parallel to a first fan-shaped portion 531, and its ends may be disposed on top of a plurality of first through holes 533.

The interlocking button portion 313 may be formed at the end of the bending selection portion 311. The interlocking button portion 313 may be inserted into one of the plurality of first through holes 533 and then released from the through hole by an applied external force, and may be returned to be inserted into an opposing through hole when the applied external force is released. Depending on the position where the interlocking button portion 313 is connected to the first fan-shaped portion 531, the angle between the bottom surface and the interlocking bar 33 may change, changing a resting portion 38's height from the bottom surface.

Specifically, the interlocking button portion 313 may allow the knee height to be adjusted based on a user's body type or body condition. Usually, it may be difficult for users who cannot extend their knees properly to hang their legs on the resting portion 38 while lying down, and, in this case, the users can work out by lifting the resting portion 38.

The interlocking bar 33 may be connected perpendicularly to the connection rotation axis 31.

The adjustment rotation axis 35 may be rotatably connected to the end of the interlocking bar 33.

The exercise control plate 37 may be formed at the end of the interlocking bar 33. The exercise control plate 37 may include a second fan-shaped portion 371 formed in a fan shape, and a plurality of second through holes 373 penetrating the second fan-shaped portion 371 and spaced apart from each other along an arc shape.

The exercise connection portion 39 may be connected to the adjustment rotation axis 35, may provide a space where the resting portion 38, on which a user's legs can rest, is mounted, and may be detachably connected to the exercise control plate 37. The exercise connection portion 39 may include an exercise selection portion 391 disposed parallel to the second fan-shaped portion 371 and having both ends disposed on top of the plurality of second through holes 373 and an exercise button portion 393 formed at the end of the exercise selection portion 391. The exercise button portion 393 may be inserted into any one of the plurality of second through holes 373 and then released from the through hole by an applied external force, and may be returned to be inserted into an opposing through hole when the applied external force is released. Depending on the position at which the exercise button portion 393 is connected to the second fan-shaped portion 371, the distance between the resting portion 38 and the seating portion 20 may be changed.

Referring back to FIG. 1, the weight portion 40 may be supported by the frame portion 10 and may accommodate a plurality of weights. The weight portion 40 will be examined in more detail with reference to FIG. 7.

Figure 7:
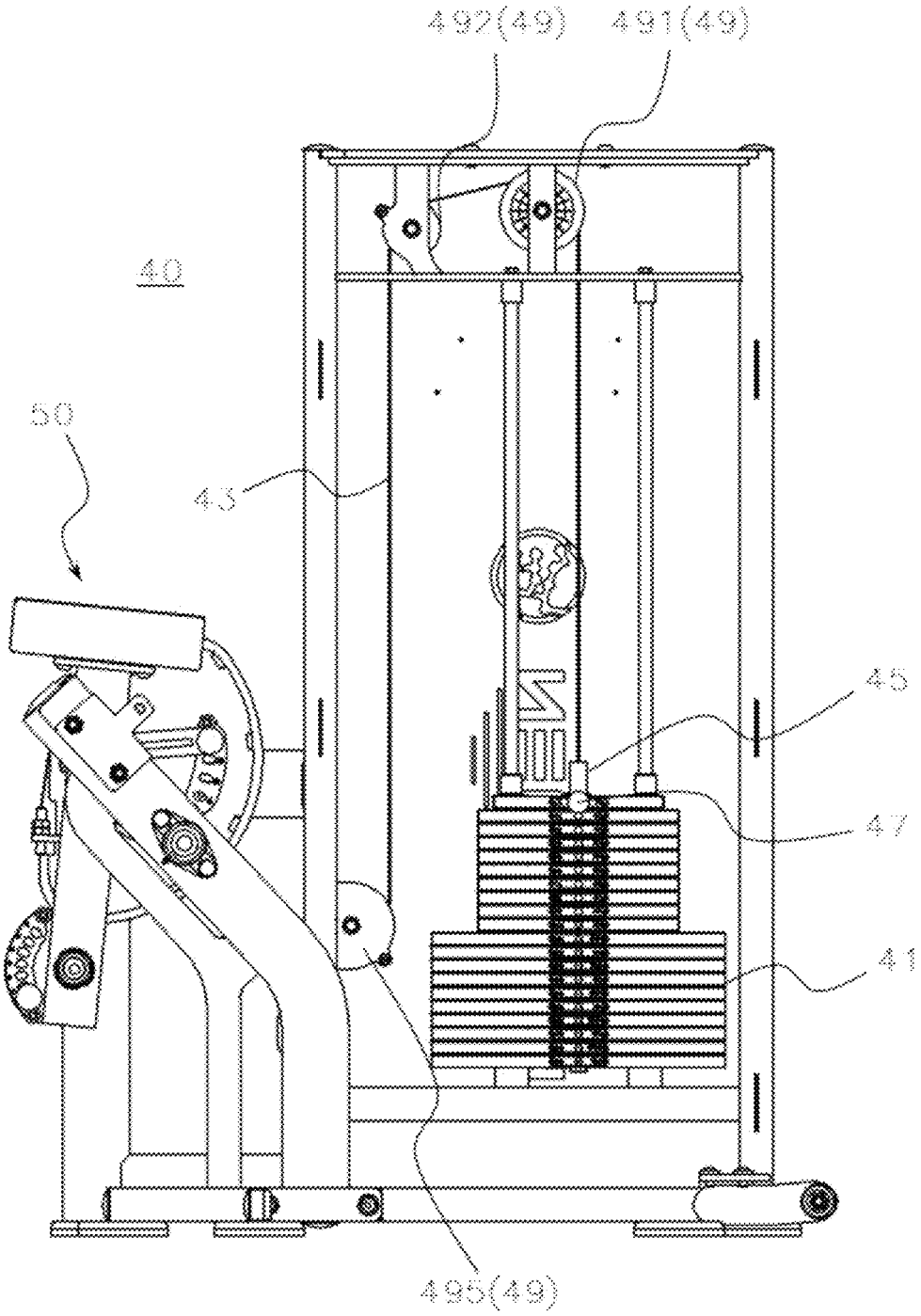
FIG. 7 is a view for illustrating a weight portion according to an embodiment of the present disclosure.

FIG. 7 is a view for illustrating the weight portion according to an embodiment of the present disclosure.

Referring to FIG. 7, the weight portion 40 according to an embodiment of the present disclosure may include a weight stacking portion 41, a wire 43, a weight mediating portion 45, an intermediate pin 47, and a guide roller 49.

The weight stacking portion 41 may be accommodated in the weight accommodating portion 13 and may be formed by stacking a plurality of weights separable from each other.

One side of the wire 43 may be connected to the weight delivering portion 50, and the other side thereof may be connected to the weight stacking portion 41. The wire 43 may raise and lower the weight stacking portion 41 based on the movement of the weight delivering portion 50.

The weight mediating portion 45 may connect the wire 43 and the weight stacking portion 41, and may allow a selected subordinate weight to vary according to how the weight stacking portion 41 is connected.

The intermediate pin 47 may determine how the weight mediating portion 45 and the weight stacking portion 41 are connected to each other.

The guide roller 49 may provide a movement path for the wire 43 while being accommodated in the weight accommodating portion 13.

The guide roller 49 may include a first upper roller piece 491, a second upper roller piece 492, and a lower roller piece 495.

The first upper roller piece 491 may be disposed on the upper side within the weight accommodating portion 13, and may be disposed on the same line as the weight mediating portion 45.

The second upper roller piece 492 may be accommodated in the weight accommodating portion 13, may be disposed adjacent to the first upper roller piece 491, and may be disposed biased toward the weight delivering portion 50.

The lower roller piece 495 may be accommodated in the weight accommodating portion 13, disposed below the second upper roller piece 492, and disposed adjacent to the weight delivering portion 50.

The guide roller 49 may maintain the wire 43 bouncy without being twisted between the weight stacking portion 41 and the weight delivering portion 50, thereby increasing the efficiency with which an external force is delivered.

Referring back to FIG. 1, the weight delivering portion 50 may be connected to the frame portion 10, may connect the exercise rotation portion 30 and the weight portion 40, and may be linked to the rotation of the exercise rotation portion 30 to raise and lower the weight of the weight portion 40. The weight delivering portion 50 will be examined in more detail with reference to FIG. 8.

Figure 8:
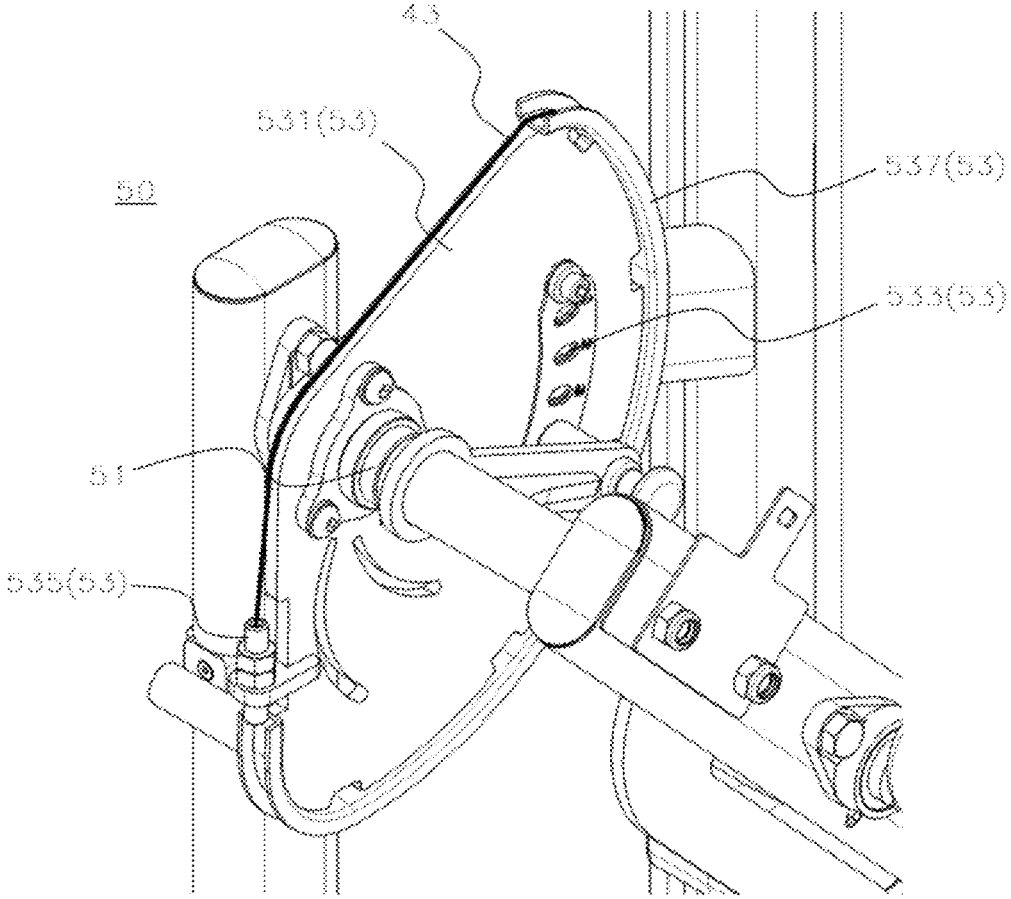
FIG. 8 is a view for illustrating a weight delivering portion according to an embodiment of the present disclosure.

FIG. 8 is a view for illustrating the weight delivering portion according to an embodiment of the present disclosure.

Referring to FIG. 8, the weight delivering portion 50 according to an embodiment of the present disclosure may include the delivering rotation axis 51 and a delivering control plate 53.

The delivering rotation axis 51 may be rotatably connected to the delivering support portion 17.

The delivering control plate 53 may be connected to and interlocked with the delivering rotation axis 51 and may be rotated by the wire 43.

The delivering control plate 53 may include the first fan-shaped portion 531, the plurality of first through holes 533, a wire fixing portion 535, and a wire guide portion 537.

The first fan-shaped portion 531 may be formed in a fan shape.

The plurality of first through holes may penetrate the first fan-shaped portion 531 and may be spaced apart from each other along an arc shape.

The wire fixing portion 535 may be formed on one side of the first fan-shaped portion 531 to fix the wire 43.

The wire guide portion 537 may guide the wire 43 fixed to the wire fixing portion 535 to be disposed along the outer peripheral surface of the first fan-shaped portion 531.

The wire guide portion 537 may prevent the wire 43 from being separated from the first fan-shaped portion 531 when the wire 43 is wound or unwound along the outer peripheral surface of the first fan-shaped portion 531.

In addition, hereinafter, an example in which the angle of the leg extension machine is adjusted will be examined with reference to FIG. 9.

Figure 9:
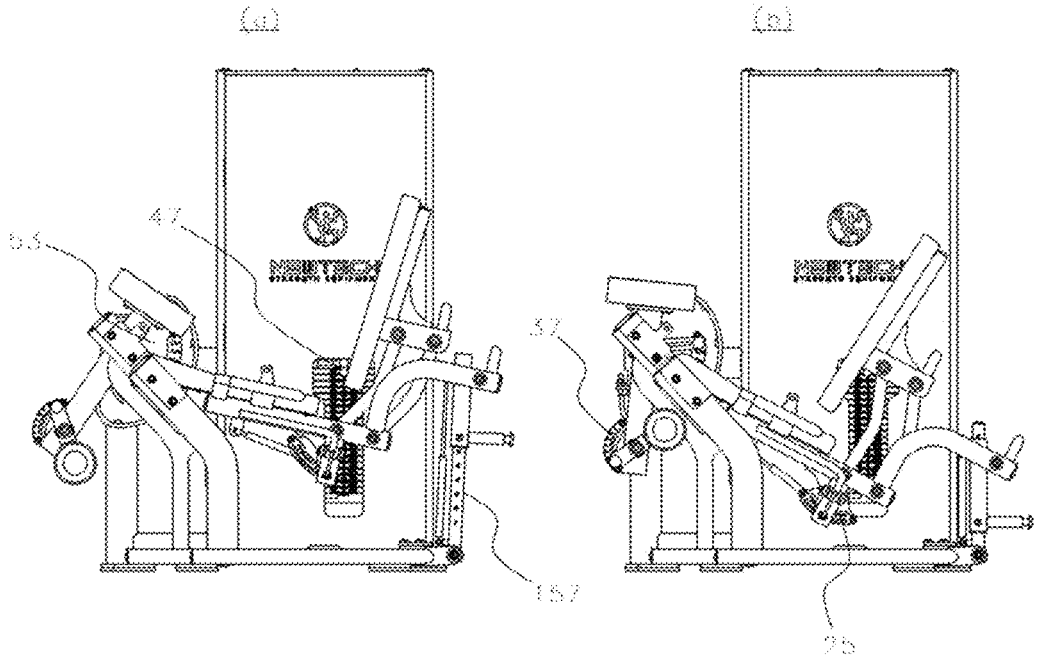
FIG. 9 is a view for comparing the leg extension machines with different angles and heights according to an embodiment of the present disclosure.

FIG. 9 is a view for comparing the leg extension machines with different angles and heights according to an embodiment of the present disclosure.

As shown in FIG. 9, it may be possible for users to work out effectively by adjusting the seating height adjuster 157, the seating angle adjuster 25, the exercise control plate 37, the intermediate pin 47, the delivering control plate 53, etc. to fit each user's body. The leg extension machine 1 according to the present disclosure can be used according to various embodiments in addition to the embodiments shown in figures (a) and (b) of FIG. 9.

As examined above, according to one embodiment of the present disclosure, it may be possible for a seated user to work out by raising a lever connected to a weight to lift the weight and adjust the leg extension machine to suit not only the length but also the thickness of the user's legs.

In addition, because the leg extension machine according to one embodiment of the present disclosure may be designed to be compact, it may be possible to not only reduce manufacturing costs but also easily maintain and manage the exercise equipment.

One embodiment of the present disclosure has been described with limited examples and drawings, but is not limited to the above-described examples. In addition, a person having ordinary skill in the art to which the present disclosure pertains can make various modifications and variations from this description. Therefore, one embodiment of the present disclosure should be understood only by the claims set forth below, and all equivalent modifications thereof can be said to fall within the scope of the technology of the present disclosure.

The invention claimed is:

1. A leg extension machine comprising:

a frame portion supported by a bottom surface thereof and standing upright;

a seating portion that is connected to the frame portion and provides a space for a user to sit, and a standing angle and a height which are adjustable;

an exercise rotation portion connected to the frame portion, disposed adjacent to the seating portion to provide a space for the user to be seated and hang his or her legs, and rotated by an external force applied by the user;

a weight portion supported by the frame portion and accommodating a plurality of weights; and a weight delivering portion connected to the frame portion, connecting the exercise rotation portion and the weight portion, and linked to the rotation of the exercise rotation portion to raise and lower the plurality of weights of the weight portion, wherein the seating portion includes:

a hip seating portion supporting buttocks of the user while seated;

a back seating portion supporting a back of the user while seated;

a seating angle adjuster connected to the frame portion and the back seating portion to be used to adjust an angle of the back seating portion; and a plurality of grip portions connected to opposing sides of the hip seating portion and arranged in parallel with the hip seating portion to be configured for gripping by the user.

2. The leg extension machine of claim 1, wherein the frame portion includes:

a lower support portion supported by the bottom surface;

a weight accommodating portion disposed at a rear of the seating portion, standing up from the lower support portion, and having an internal space to accommodate the weight portion;

a seating support portion standing up from the lower support portion and supporting the seating portion;

a delivering support portion standing up from the lower support portion and disposed adjacent to the weight accommodating portion to support the weight delivering portion; and an exercise support portion connecting the delivering support portion and the seating support portion and supporting the exercise rotation portion, wherein the seating support portion includes:

a pair of seating support pieces supporting the hip seating portion;

a pair of bending support pieces extending from a first point of the pair of seating support pieces;

a rotating support piece connecting the pair of seating support pieces and the back seating portion, wherein a plurality of rotational links are provided in a space between the pair of seating support pieces so that the back seating portion rotates; and a seating height adjuster arranged to adjust a height of the pair of bending support pieces and having one end link-connected to one point of the lower support portion and another end link-connected to the pair of bending support pieces.

3. The leg extension machine of claim 2, wherein the seating angle adjuster includes:

an angle adjusting plate fixed to the plurality of rotational links, operating in conjunction with the back seating portion, and formed in a fan shape;

a plurality of angle adjusting holes penetrating the angle adjusting plate and spaced apart from each other along an arc shape;

a fixing lever module coupled to a second point of the pair of seating support pieces and inserted into at least one of the plurality of angle adjusting holes to fix the angle of the back seating portion; and a damper connecting a third point of the pair of seating support pieces and a first point of the angle adjusting plate and pulling the angle adjusting plate toward the third point of the pair of seating support pieces when the fixing lever module is released.

4. The leg extension machine of claim 3, wherein the weight portion includes:

a weight stacking portion accommodated in the weight accommodating portion and formed by stacking the plurality of weights separable from each other;

a wire having one side connected to the weight delivering portion and another side connected to the weight stacking portion, wherein raising and lowering the weight stacking portion is based on movement of the weight delivering portion;

a weight mediating portion connecting the wire and the weight stacking portion and allowing a selected subordinate weight to vary according to how the weight stacking portion is connected;

an intermediate pin determining how the weight mediating portion and the weight stacking portion are connected to each other; and a guide roller providing a movement path for the wire while being accommodated in the weight accommodating portion, wherein the guide roller includes:

a first upper roller piece disposed on an upper side within the weight accommodating portion and disposed on a same line as the weight mediating portion;

a second upper roller piece accommodated in the weight accommodating portion, disposed adjacent to the first upper roller piece, and disposed biased toward the weight delivering portion; and a lower roller piece accommodated in the weight accommodating portion, disposed below the second upper roller piece, and disposed adjacent to the weight delivering portion, wherein the weight delivering portion includes:

a delivering rotation axis connected rotatably to the delivering support portion; and a delivering control plate connected to and interlocked with the delivering rotation axis and rotated by the wire, and wherein the delivering control plate includes:

a first fan-shaped portion formed in a fan shape;

a plurality of first through holes penetrating the first fan-shaped portion and spaced apart from each other along an arc shape;

a wire fixing portion formed on one side of the first fan-shaped portion to fix the wire; and a wire guide portion guiding the wire fixed to the wire fixing portion to be disposed along an outer peripheral surface of the first fan-shaped portion.

5. The leg extension machine of claim 4, wherein the exercise rotation portion includes:

a connection rotation axis formed in concentric multi-stages to surround an outer peripheral surface of the delivering rotation axis and connected thereto to rotate around the delivering rotation axis;

an interlocking bar connected perpendicularly to the connection rotation axis;

an adjustment rotation axis connected rotatably to an end of the interlocking bar;

an exercise control plate formed at another end of the interlocking bar; and an exercise connection portion connected to the adjustment rotation axis, providing a space wherein a resting portion, on which the user's legs can rest, is mounted, and connected detachably to the exercise control plate, wherein the connection rotation axis includes:

a bending selection portion disposed parallel to the first fan-shaped portion and having opposing ends disposed on top of the plurality of first through holes; and an interlocking button portion formed at one of the opposing ends of the bending selection portion, inserted into one of the plurality of first through holes and then released from the one of the plurality of first through holes by an applied external force, and returned to be inserted into a different one of the plurality of first through holes when the applied external force is released, depending on a position where the interlocking button portion is connected to the first fan-shaped portion, an angle between the bottom surface and the interlocking bar changes, changing a height of the resting portion from the bottom surface, wherein the exercise control plate includes:

a second fan-shaped portion formed in a fan shape; and a plurality of second through holes penetrating the second fan-shaped portion and spaced apart from each other along an arc shape, wherein the exercise connection portion includes:

an exercise selection portion disposed parallel to the second fan-shaped portion and having opposing ends disposed on top of the plurality of second through holes; and an exercise button portion formed at one of the opposing ends of the exercise selection portion, inserted into any one of the plurality of second through holes and then released from the one of the plurality of second through holes by a second applied external force, and returned to be inserted into a different one of the plurality of second through holes when the second applied external force is released, and depending on a position at which the exercise button portion is connected to the second fan-shaped portion, a distance between the resting portion and the seating portion is changed.

* * * * *